US005820122A

United States Patent [19]

Schneider

[11] Patent Number: 5,820,122

[45] Date of Patent: Oct. 13, 1998

[54] SHEET GUIDING DEVICE IN FOLDING APPARATUS OF PRINTING MACHINE

[75] Inventor: Eckhard Schneider, Stadtberqen, Germany

[73] Assignee: Man Roland Druckmaschinen AG, Augsburg, Germany

[21] Appl. No.: 746,637

[22] Filed: Nov. 13, 1996

[30] Foreign Application Priority Data

Sep. 6, 1996 [DE] Germany ..... 196 36 172.9

[51] Int. Cl.[6] ..... B65H 29/70

[52] U.S. Cl. ..... 271/188; 271/273; 271/274; 271/315

[58] Field of Search ..... 271/3, 2, 273, 271/274, 187, 188, 198, 315, 67, 65, 70

[56] References Cited

U.S. PATENT DOCUMENTS

| | | | |
|---|---|---|---|
| 4,106,767 | 8/1978 | Schirrmeister et al. | 271/198 |
| 4,120,491 | 10/1978 | Lang | 271/187 |
| 4,487,408 | 12/1984 | Fischer | 271/187 |
| 4,925,179 | 5/1990 | Breton et al. | 271/187 |
| 4,964,627 | 10/1990 | Watts et al. | 271/188 |
| 5,029,842 | 7/1991 | Belanger et al. | 271/188 |

FOREIGN PATENT DOCUMENTS

| | | | |
|---|---|---|---|
| 0280087 | 6/1990 | Germany | 271/315 |
| 0198244 | 11/1984 | Japan | 271/274 |
| 0046859 | 2/1987 | Japan | 271/188 |
| 404133959 | 5/1992 | Japan | 271/273 |

*Primary Examiner*—H. Grant Skaggs
*Attorney, Agent, or Firm*—Graham & James LLP

[57] ABSTRACT

A method and apparatus for guiding a sheet in a folding device of a printing machine includes a belt conveyor system and a bucket wheel conveyor system including a bucket wheel. The belt conveyor system includes two belts rotated by a plurality of rollers. Two of the rollers are disposed at a delivery area near the bucket wheel. The two rollers include a ridge imparting mechanism for introducing a ridge or corrugation to a sheet being fed between the belts and between the rollers. The two rollers are disposed in a common horizontal plane and are spaced at a substantially equal distance from the bucket wheel in a vertical direction relative to the bucket wheel. At least one of the two rollers is adjustable relative to the other roller so as to adjustably increase or decrease a degree or depth of ridge that is applied to the sheet. A guide member is disposed between the two rollers and the bucket wheel to prevent a sheet from being diverted from the bucket wheel.

19 Claims, 2 Drawing Sheets

SHEET GUIDING DEVICE IN FOLDING APPARATUS OF PRINTING MACHINE

BACKGROUND OF THE INVENTION

I. Field of the Invention

This invention relates to a method and apparatus for guiding sheets in a folding apparatus of a printing machine, and more particularly, to a method and apparatus for guiding sheets from a belt conveyor system to a bucket-wheel conveyor system in a folding apparatus of a printing machine.

II. Description of Related Art

U.S. Pat. No. 5,029,842 and EP 0 374 917 B1 show a system for transporting signatures or folded sheets from a belt conveyor system to a bucket wheel. The belt conveyor system comprises two separate endless belts, with each of the belts being rotated by a corresponding set of rollers. The two separate belts are arranged next to each other so as to cooperate with each other to move a signature to a delivery area located adjacent a bucket wheel for delivering the signatures from the belt conveyor system to the bucket wheel. Near the delivery area, each of the two belts of the belt conveyor system is led over one of the plurality of rollers used for rotating the belts.

The rollers located near the delivery area contain a device for imparting a ridge or corrugation in each of the signatures being transferred from the belt conveyor system to the bucket wheel. The ridge or corrugation is introduced into the signature to make sure that the signature is reliably and accurately fed from the belt conveyor system to the bucket wheel.

To impart the ridge to the signature, one of the rollers near the delivery area comprises a shaping roller and contains an elastically yieldable outer member which is adapted to introduce a ridge or corrugation into the signature. The elastically yieldable outer member of the shaping roller engages and is driven against the two belts with the signature disposed between the two belts so as to impart the ridge or corrugation to the signature.

There is an additional roller provided near the delivery roller. The additional roller is used to move a first of the two belts and for guiding the signature to the bucket wheel. The shaping roller, which is used to move a second of the two belts, is spaced vertically from the additional roller such that the additional roller is located a first distance from the bucket wheel and the shaping roller is located a second distance from the bucket wheel, wherein the first distance is less than the second distance. Thus, the shaping roller does not engage or cooperate with the additional roller to impart the ridge or corrugation. Instead, as described above, the shaping roller cooperates with the two belts to impart the ridge or corrugation to the signature.

In this device, because of the vertical misalignment of the two rollers and the radially yieldable outer member of the shaping roller, only a very light ridge or corrugation is introduced to the signature. As a result, the presence of the ridge or corrugation in the signature is only short-term and is not sufficient for the time required for the signature to be transferred from the belt conveyor system to the bucket wheel. The signature is therefore not reliably transported into a bucket of the bucket wheel. Furthermore, the signature is bent over its width laterally relative to the direction of transport and for this reason, the signature bends back after it has passed the shaping roller which results in changes in the transport direction of the beginning or leading edge of the signature so that the signature does not reliably reach a bucket of the bucket wheel. Such changes in transport direction may be caused by static electricity or charges on the signature or various forces imparted to the signature during transport. A further difficulty is that these changes in direction vary depending on the transport speed of the signature.

In addition, the force imparted by the radially yieldable member on the shaping roller to the signature cannot be adjusted. Therefore, if a ridge or corrugation formed by the shaping roller in a signature is determined to be too light or not capable of remaining in the signature for a sufficient period of time, no adjustment can be made to increase the amount or depth of the ridge or corrugation. Thus, it is not possible to adjust the force imparted by the shaping roller to a signature to account for an insufficient ridge or corrugation or to accommodate varying thicknesses and/or flexibilities of varying materials being folded by the folding apparatus.

Even if the position of the additional roller were adjusted to not be vertically spaced from the shaping roller but instead to be disposed in the same horizontal plane as the shaping roller relative to the bucket wheel, the signature could still be diverted from the bucket wheel due to changes in the transport direction of the beginning or leading edge of the signature mentioned above.

BRIEF DESCRIPTION OF THE PRESENT INVENTION

The preferred embodiments of the present invention provide a method and apparatus for guiding sheets in a folding apparatus of a printing machine for reliably transferring the signatures from a belt conveyor system to a bucket-wheel conveyor system in a folding apparatus of a printing machine.

The preferred embodiments of the present invention overcome the disadvantages described above by providing an improved sheet guiding apparatus in a folding device of a printing machine wherein the sheet guiding apparatus comprises a belt conveyor system including first and second belts for feeding a sheet to a delivery area, a first and second roller located near the delivery area for moving the first and second belts in a rotating manner so as to move a sheet from the belt conveyor system to a bucket conveyor system including a bucket wheel, the first and second rollers being located in a common horizontal plane and being spaced from and substantially equidistant from the bucket wheel in a vertical direction relative to the bucket wheel, one of the first and second roller including a ridge imparting member for imparting a ridge to a sheet being guided between the first and second belts, wherein one of the first and second rollers is adjustable relative to the other of the first and second rollers to adjust an amount of pressure applied by the one of the first and second rollers and to adjust a depth of the ridge imparted to the sheet.

Another preferred embodiment of the present invention provides an improved sheet guiding apparatus in a folding device of a printing machine wherein the sheet guiding apparatus comprises a belt conveyor system including first and second belts for feeding a sheet to a delivery area, a first and second roller located near the delivery area for moving the first and second belts in a rotating manner so as to move a sheet from the belt conveyor system to a bucket conveyor system including a bucket wheel, the first and second rollers being located in a common horizontal plane and being spaced from and substantially equidistant from the bucket wheel in a vertical direction relative to the bucket wheel, a guide member disposed between the first and second rollers and the bucket wheel for guiding the sheet from the belt conveyor system to the bucket conveyor system, wherein one of the first and second roller including a ridge imparting member for imparting a ridge to a sheet being guided between the first and second belts.

The preferred embodiments of the present invention solve the problems of sheets being diverted from and prevented from being reliably and accurately fed from a belt conveyor system to a bucket wheel conveyor by imparting a sufficiently deep ridge to a sheet such that the ridge will remain in the sheet until the sheet is received in the bucket wheel and by preventing the transport direction of the sheet from being diverted by providing the guiding member between the rollers and the bucket wheel. With the preferred embodiments of the present invention, ridges for achieving reliable delivery of sheets to a bucket wheel can be sufficiently imparted to sheets having varying thicknesses and flexibilities and a depth of the ridge can be quickly and easily adjusted to ensure sufficient formation of ridges in the sheets.

Other features and advantages of the present invention will become apparent from the following description of the preferred embodiments of the invention which are shown in the accompanying drawings.

DETAILED DESCRIPTION OF PREFERRED EMBODIMENTS

Figure 1:
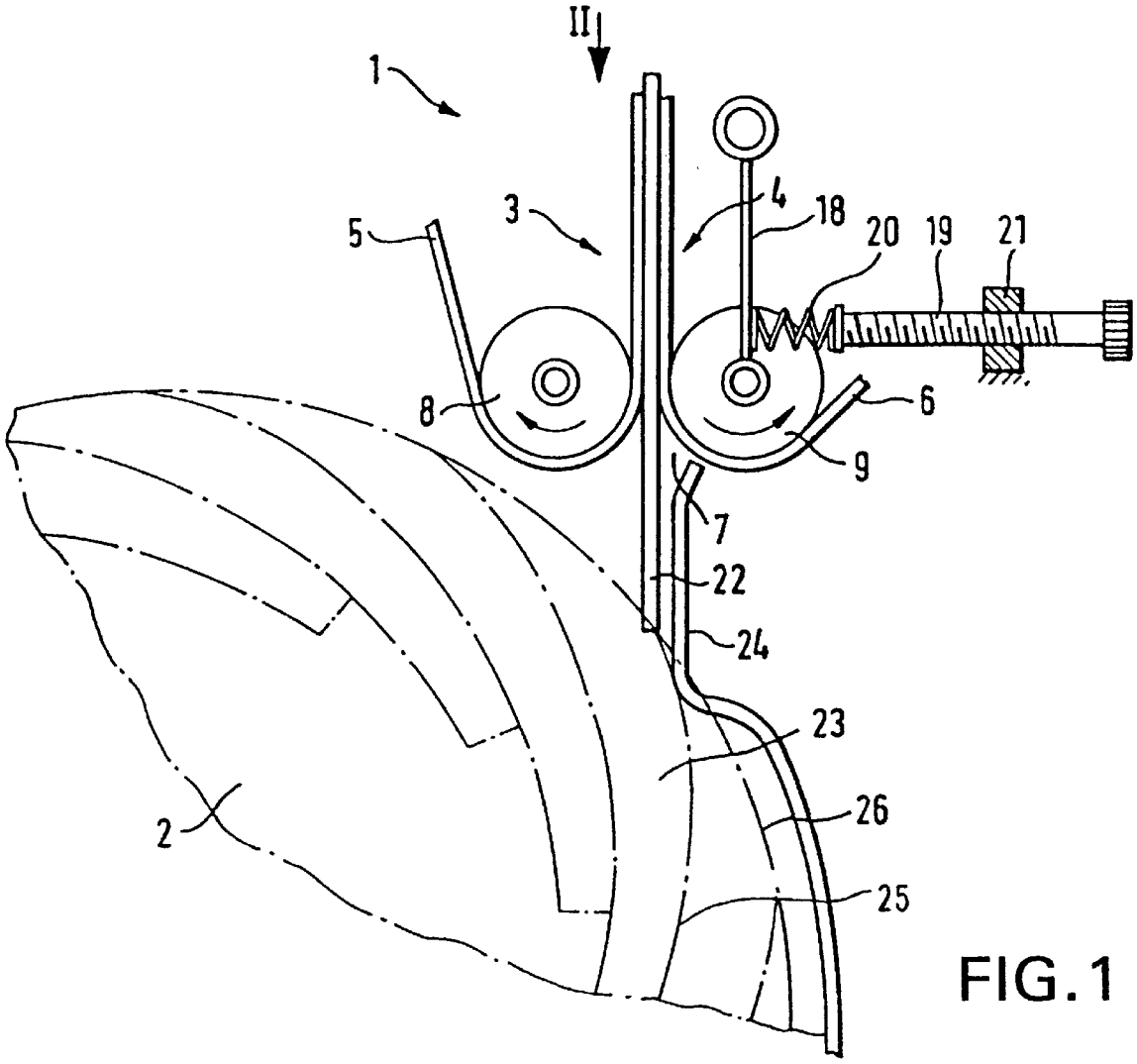
FIG. 1 is a schematic view of a sheet guiding apparatus in a folding apparatus according to a preferred embodiment of the present invention.

The apparatus for guiding sheets in a folding apparatus shown in FIG. 1 includes a belt conveyor system 1 and a further transport system positioned below this in the form of a bucket wheel 2. The belt conveyor system 1 comprises two independent belt systems 3, 4 each including a rotating belt 5, 6, respectively. At the delivery station 7 of the belt conveyor system 1, the belts 5, 6 are each guided on correspondingly located running surfaces of rollers 8, 9. These running surfaces are cylindrical surfaces of discs 10, 11 shown in FIG. 2 which are positioned in rows. The rollers 8, 9 also include additional elements described below which are mounted on axles 12 of the rollers 8, 9. The roller 8 includes circumferential recesses 13 which are defined by a plurality of discs 14 which are smaller in diameter than the discs 10 and which are positioned between the discs 10. Opposite to and meshing with the recesses 13 of the roller 8, the roller 9 has a plurality of raised members 15 having a camber.

As seen in FIG. 1, the rollers 8, 9 are disposed in a common horizontal plane relative to the bucket wheel 2 and are spaced substantially equidistant from the bucket wheel in a vertical direction relative to the bucket wheel so as to form a sandwich arrangement for imparting a ridge to a sheet and guiding a sheet to the bucket wheel 2. Because of the sandwich arrangement of the rollers 8, 9, the raised camber members 15 are preferably designed as rings 16 which pivot freely on a body 17 disposed between the discs 11 on the axle 12. The camber 15 preferably includes an outer surface having an ink-repelling plastic film such as PTFE film disposed thereon. Alternatively, the rollers 8, 9 can be designed in a different manner, e.g. with sleeves containing the various profiles shown in FIG. 2 and being mountable on the axles 12.

At least one of the rollers 8, 9 is adjustably mounted relative to the other roller. Alternatively, both rollers 8, 9 may be pivotable relative to each other. Thus, as shown in FIG. 1, at least one of the rollers 9 is adjustably mounted relative to the other roller 8 in the frame of the folding device. As seen in FIG. 1, the bearing of the roller 9 is indirectly mounted via a lever 18 connected to the journals of the roller 9. The lever 18 is supported so as to be pivotable or rotatable about a fixed point to which the lever 18 is fixed. The pivoting capability of the lever 18 allows for a distance between the rollers 8, 9 to be adjusted and therefore, allows an amount of force and depth of a ridge imparted by the rollers 8, 9 to a sheet to be adjusted. For this purpose, a screw 19 or other actuating member presses on the lever 18 under interposition of a compression spring 20. Each screw 19 is screwed into a screw nut 21 fixed on the frame. By turning the screw 19, the roller 9 can be disposed against the roller 8 with more or less force as desired. The screw 19 can also be directed directly against the levers 18 while omitting the compression spring 20 such that the change in distance and force between the rollers 8, 9 is achieved when the screw 19 is actuated. It is also possible for both rollers 8, 9 to be designed in an adjustable manner. The pressure on the lever 18 can, for example, also be effected using pressure cylinders such as a known hydraulic piston and cylinder arrangement. The adjustment can also be effected by other means, e.g. using cams or other suitable devices.

A product 22, for example a pre-folded and cut signature delivered from a cutting cylinder not shown, transported by belt conveyor system 1 between its belt systems 3, 4, leaves the belt conveyor system 1 at the delivery station 7 in order to be transferred to a chamber 23 of the bucket wheel located below it. The product 22 can, for example, comprise merely cut sheets. To ensure that the product 22 is transported reliably into the chamber 23, the distance between the bucket wheel 2 and the delivery station 7 located adjacent the rollers 8,9 is smaller than the length of the product 22. Moreover, the product 22 is imparted with a ridge extending out of a normal plane of the product 22 by means of the ridging device defined by the cambers 15 of the roller 9 and the recesses 13 of the roller 8 so that as a result of the reinforcement thus received by the screw 19, lever 18 and spring 20, the product 22 is transferred securely into the chamber 23. The degree or depth of ridging is set using the screw 19. With a more powerful setting of the rollers 8, 9 against each other, the cambers 15 penetrate the recesses 13 more deeply so that a greater degree or depth of the ridge is produced.

To prevent a product 22 from being diverted during delivery from the rollers 8, 9 to the bucket wheel 2, a guiding member 24 is positioned laterally on the bucket wheel 2 leading up to the roller 9 disposed above it. The guiding member 24 is situated in an area between the buckets 25 of the bucket wheel 2 and can thus reach up into the enveloping circle 26 of the bucket wheel 2. The guiding member 24 prevents a lateral escape of the products 22, e.g. caused by static charging. The guide member 24 includes a first straight portion 24*a* disposed adjacent the delivery area 7 and a curved portion 24*b* which extends around the enveloping circle 26 of the bucket wheel 2. As a result of the configuration and arrangement of the guide member 24, the product 22 is prevented from being diverted and the product is reliably fed to a bucket 23 of the bucket wheel 2.

Figure 2:
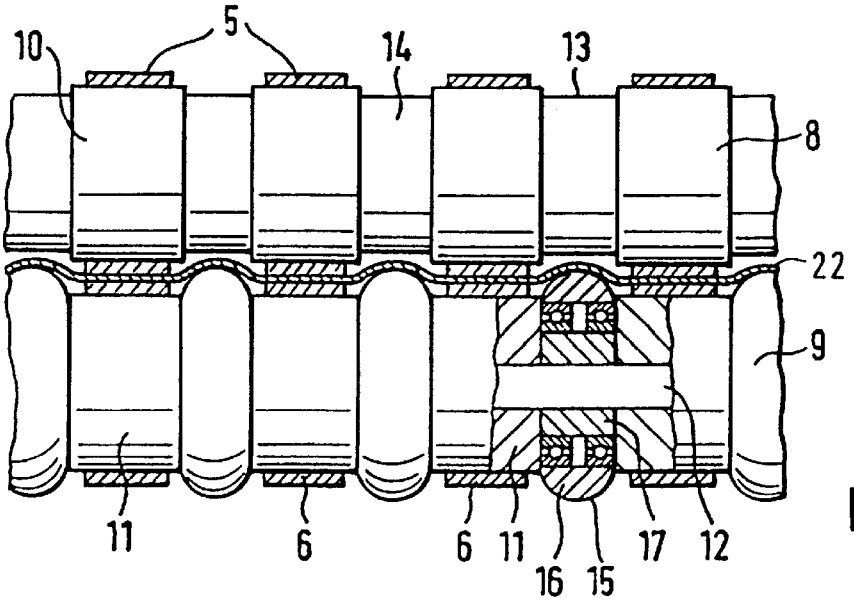
FIG. 2 is a cross section view along line II in FIG. 1.
Figure 3:
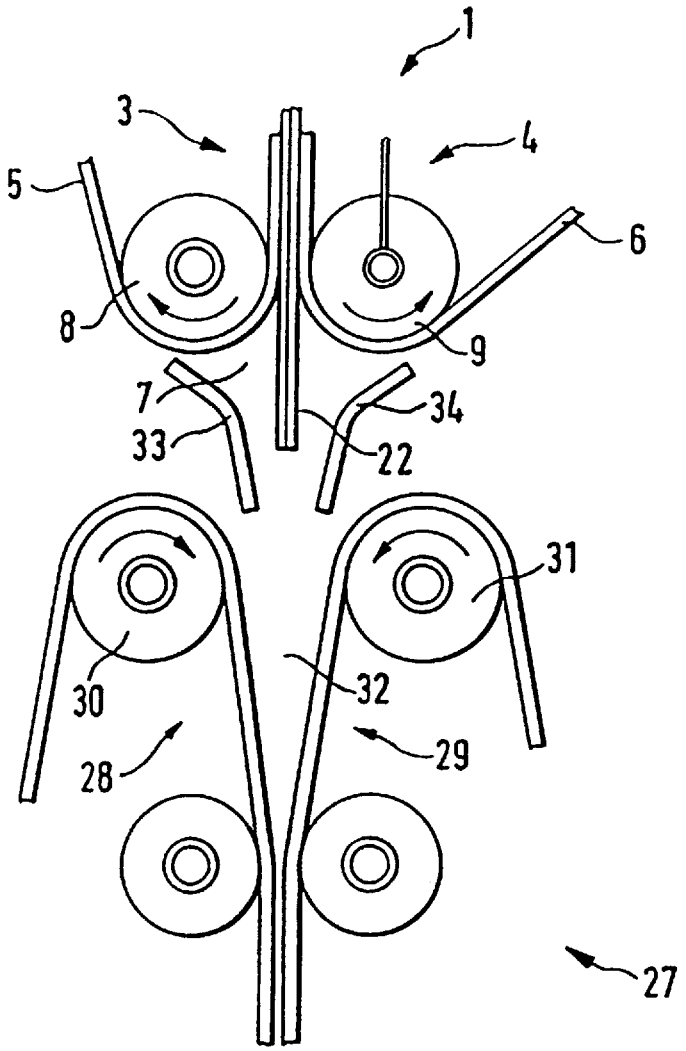
FIG. 3 is a schematic view of an alternative preferred embodiment of a sheet guiding apparatus.

In an alternative embodiment shown in FIG. 3, the apparatus of the preferred embodiments of the present invention can also be used if instead of the bucket wheel 2 a different transport system is used to receive a product 22 from the belt conveyor system 1. As seen in FIG. 3, a further belt conveyor system 27 including belt systems 28, 29 forms an entry gap 32 by means of rollers 30, 31 disposed at corresponding distances from each other. The belt conveyor system 1 resembles that in FIGS. 1 and 2 so that for reasons of simplicity the same drawing references are used and detailed explanations can be dispensed with. On leaving the belt conveyor system 1 at the delivery station 7, the product 22 is ridged by means of the ridging device contained in the rollers 8, 9 and transferred reliably with the reinforcement thus received into the entry gap 32 of the belt conveyor system 27. The product 22 is received between the belt systems 28, 29 and is then further transported via the belt conveyor system 27. A plurality of guide members 33, 34 are preferably provided between the rollers 8 and 30 or 9 and 31 to prevent any lateral escape of the products 22, e.g. due to static charging.

It should be noted that although the preferred embodiments of the present invention shown in FIGS. 1–3 are described as having one lever 18, screw 19, spring 20, guide member 24, guide members 33, 34, a plurality of these elements may be disposed along a length of the rollers 8, 9 and bucket wheel 2 or rollers 8, 9 and 30, 31.

Although the present invention has been described in relation to particular preferred embodiments thereof, many other variations and modifications and other uses will become apparent to those skilled in the art. It is preferred, therefore, that the present invention be limited not by the specific disclosure herein, but only by the appended claims.

What is claimed is:

1. A sheet guiding apparatus of a folding device in a printing machine comprising:

a belt conveyor system including first and second belts for feeding a sheet to a delivery area;

a bucket conveyor system including a bucket wheel;

a first and second roller located near the delivery area for moving the first and second belts in a rotating manner so as to move a sheet from the belt conveyor system to the bucket wheel of the bucket conveyor system; wherein the first and second rollers are located in a common horizontal plane and are spaced by a substantially equal distance from the bucket wheel in a vertical direction relative to the bucket wheel, one of the first and second rollers includes a ridge imparting device for imparting a ridge to a sheet being guided between the first and second belts, wherein one of the first and second rollers is adjustable relative to the other of the first and second rollers to adjust an amount of pressure applied by the one of the first and second rollers and to adjust a depth of the ridge imparted to the sheet.

2. The apparatus of claim 1, further comprising a lever and a biasing device for adjustably biasing the lever, wherein the one of the first and second rollers is connected to lever so as to be adjustably biased against the other of the first and second rollers.

3. The apparatus of claim 2, wherein the biasing device includes a spring member and an actuating member for adjusting a position of the one of the first and second rollers relative to the other of the first and second rollers.

4. The apparatus of claim 1, further comprising at least one guide member disposed between the first and second rollers and the bucket wheel.

5. The apparatus of claim 4, wherein the at least one guide member includes a substantially straight portion disposed adjacent the first and second rollers and a curved portion disposed adjacent the bucket wheel.

6. The apparatus of claim 1, wherein the ridge imparting device comprises a plurality of raised camber members disposed on the one of the first and second rollers.

7. The apparatus of claim 6, wherein the ridge imparting device further comprises a plurality of recessed portions disposed on an outer surface of the other of the first and second roller, the plurality of recessed portions being disposed opposite to the plurality of raised camber members.

8. An improved sheet guiding apparatus in a folding device of a printing machine, the sheet guiding apparatus comprising:

a belt conveyor system including first and second belts for feeding a sheet to a delivery area;

a bucket conveyor system including a bucket roller;

a first and second roller located near the delivery area for moving the first and second belts in a rotating manner so as to move a sheet from the belt conveyor system to the bucket wheel of the bucket conveyor system, the first and second rollers being located in a common horizontal plane and being spaced from and substantially equidistant from the bucket wheel in a vertical direction relative to the bucket wheel; and at least one guide member disposed between the first and second rollers and the bucket wheel for guiding the sheet from the belt conveyor system to the bucket conveyor system; wherein one of the first and second roller includes a ridge imparting member for imparting a ridge to a sheet being guided between the first and second belts; and one of the first and second rollers is adjustable relative to the other of the first and second rollers to adjust an amount of pressure applied by the one of the first and second rollers and to adjust a depth of the ridge imparted to the sheet.

9. The apparatus of claim 8, further comprising a lever and a biasing device for adjustably biasing the lever, wherein the one of the first and second rollers is connected to lever so as to be adjustably biased against the other of the first and second rollers.

10. The apparatus of claim 9, wherein the biasing device includes a spring member and an actuating member for adjusting a position of the one of the first and second rollers relative to the other of the first and second rollers.

11. The apparatus of claim 8, wherein the at least one guide member includes a substantially straight portion disposed adjacent the first and second rollers and a curved portion disposed adjacent the bucket wheel.

12. The apparatus of claim 8, wherein the ridge imparting device comprises a plurality of raised camber members disposed on the one of the first and second rollers.

13. The apparatus of claim 12, wherein in ridge imparting device further comprises a plurality of recessed portions disposed on an outer surface of the other of the first and second roller, the plurality of recessed portions being disposed opposite to the plurality of raised camber members.

14. A sheet guiding apparatus of a folding device in a printing machine comprising:

a first belt conveyor system including first and second belts for feeding a sheet to a delivery area;

a second belt conveyor system including third and fourth belts for receiving a sheet from the delivery area;

a first and second roller located near the delivery area for moving the first and second belts in a rotating manner so as to move a sheet from the first belt conveyor system to the second belt conveyor system; wherein the first and second rollers are located in a common horizontal plane and are spaced by a substantially equal distance from the second belt conveyor system in a vertical direction relative to the second belt conveyor system, one of the first and second rollers includes a ridge imparting device for imparting a ridge to a sheet being guided between the first and second belts, wherein one of the first and second rollers is adjustable relative to the other of the first and second rollers to adjust an amount of pressure applied by the one of the first and second rollers and to adjust a depth of the ridge imparted to the sheet.

15. The apparatus of claim 14, further comprising a lever and a biasing device for adjustably biasing the lever, wherein the one of the first and second rollers is connected to lever so as to be adjustably biased against the other of the first and second rollers.

16. The apparatus of claim 15, wherein the biasing device includes a spring member and an actuating member for adjusting a position of the one of the first and second rollers relative to the other of the first and second rollers.

17. The apparatus of claim 16, further comprising a pair of guide member disposed between the first belt conveyor system and the second belt conveyor system.

18. The apparatus of claim 14, wherein the ridge imparting device comprises a plurality of raised camber members disposed on the one of the first and second rollers.

19. The apparatus of claim 18, wherein the ridge imparting device further comprises a plurality of recessed portions disposed on an outer surface of the other of the first and second roller, the plurality of recessed portions being disposed opposite to the plurality of raised camber members.

* * * * *